United States Patent [19]

Beale

[11] Patent Number: 4,955,089

[45] Date of Patent: Sep. 11, 1990

[54] TWO-PIECE HARD HAT

[75] Inventor: Jeremy H. Beale, 8084 Beacon La., Northville, Mich. 48167

[73] Assignee: Jeremy H. Beale, Northville, Mich.

[21] Appl. No.: 309,168

[22] Filed: Feb. 13, 1989

[51] Int. Cl.[5] ..... A42B 3/32

[52] U.S. Cl. ..... 2/410; 2/171.1

[58] Field of Search ..... 2/171, 171.1, 171.2, 2/175, 195, 209.1, 209.3, 410, 6, 411, 421, 425

[56] References Cited

U.S. PATENT DOCUMENTS

| | | | |
|---|---|---|---|
| 1,542,000 | 6/1925 | Parsons | 2/171.1 |
| 2,585,937 | 2/1952 | Johnson et al. | 2/3 |
| 2,604,630 | 7/1952 | Waring | 2/175 |
| 2,853,708 | 9/1958 | Austin | 2/3 |
| 2,855,604 | 10/1958 | Austin | 2/3 |
| 3,087,164 | 4/1963 | Gilbert | 2/3 |
| 3,107,356 | 10/1963 | Pestronk et al. | 2/3 |
| 3,353,188 | 11/1967 | Crincic | 2/171.1 |
| 3,423,763 | 1/1969 | Schwartz | 2/171 |
| 3,629,864 | 12/1971 | Latina | 2/3 |
| 3,987,495 | 10/1976 | Holley | 2/410 |
| 3,991,422 | 11/1976 | Saotome | 2/410 |
| 4,023,212 | 5/1977 | Huffman | 2/171.1 |
| 4,091,469 | 5/1978 | Davidson | 2/410 |
| 4,091,470 | 5/1978 | Ryunoshin | 2/410 |
| 4,109,323 | 8/1978 | Matthias | 2/410 |
| 4,607,397 | 8/1986 | Laxo | 2/410 |

FOREIGN PATENT DOCUMENTS

| | | | |
|---|---|---|---|
| 74658 | 3/1983 | European Pat. Off. | 2/410 |
| 2817528 | 3/1979 | Fed. Rep. of Germany | 2/410 |
| 912204 | 8/1946 | France | 2/175 |
| 2422348 | 12/1979 | France | 2/410 |
| 2546381 | 11/1984 | France | 2/410 |
| 2041724 | 9/1980 | United Kingdom | 2/410 |
| 2070413 | 9/1981 | United Kingdom | 2/209.1 |

*Primary Examiner*—Werner H. Schroeder
*Assistant Examiner*—Diana L. Biefeld
*Attorney, Agent, or Firm*—Harness, Dickey & Pierce

[57] ABSTRACT

A two-piece hard hat is disclosed which enables the hard hat to be disassembled for carrying in an ordinary brief case. The hard hat is separable along a line approximately midway along the vertical height of the hard hat into an upper crown member and a lower skirt member. The vertical heights of the individual members are approximately half of the vertical height of the completed assembly to minimize the space necessary to store the hard hat.

3 Claims, 1 Drawing Sheet

TWO-PIECE HARD HAT

BACKGROUND AND SUMMARY OF THE INVENTION

This invention pertains to hard hats for protection of the wearer's head and in particular to two-piece hard hats which enable the hard hat to be disassembled and stored in a conventional brief case.

Visitors to construction or manufacturing sites are often required to wear a hard hat to protect the wearer's head from impact caused by falling objects or from other hazards. Persons who are frequent visitors to such sites generally must carry a hard hat with them to assure that a hard hat will be available when such a visit is made. However, conventional hard hats are generally of a one-piece construction which are bulky and generally difficult to transport.

Accordingly, it is an object of this invention to provide a two-piece hard hat which can be disassembled to be carried in an ordinary brief case and assembled at a job site for use.

The two-piece hard hat of this invention includes an upper crown member forming a dome and a skirt member which extends downwardly from the periphery of the crown member and forms a brim at its lower end. A tongue and groove joint is formed along a periphery of the crown member and the upper end of the skirt member for joining the two members together. A seal is disposed in the groove to prevent leakage of liquids into the hard hat between the two members. Several clips extend downward from the crown member and engage corresponding studs extending radially outward from the skirt member. The spring members frictionally fit between the heads of the studs and the skirt member to secure the crown and skirt members together.

The hard hat head band and crown straps are attached to the inner side of the skirt member and protective padding can be secured to the inside of the crown member.

The tongue and groove joint between the two members assures that any loading applied to the crown member from falling objects will be transmitted to the skirt member and distributed over the crown straps which cover the wearer's head.

Further objects, features and advantages of the invention will become apparent from a consideration of the following description and the appended claims when taken in connection with the accompanying drawings.

DETAILED DESCRIPTION OF THE INVENTION

Figure 1:
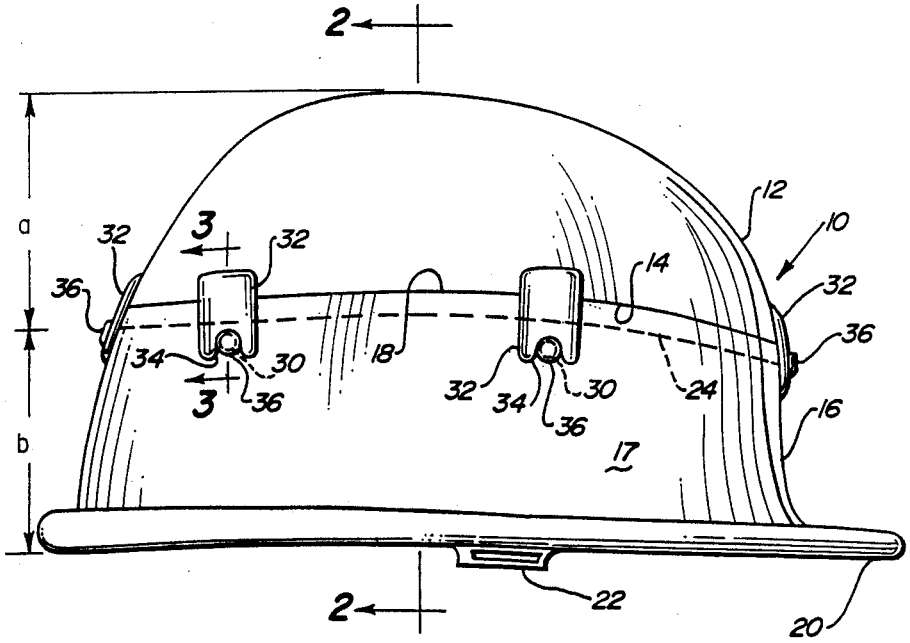
FIG. 1 is a side elevational view of the two-piece hard hat of this invention.
Figure 3:
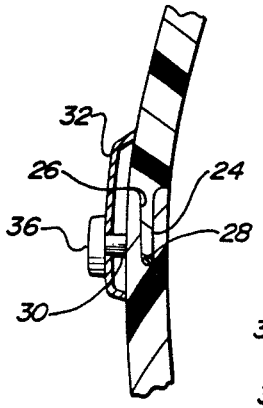
FIG. 3 is an enlarged sectional view of the hard hat of this invention as seen from the line 3—3 of FIG. 1.
Figure 2:
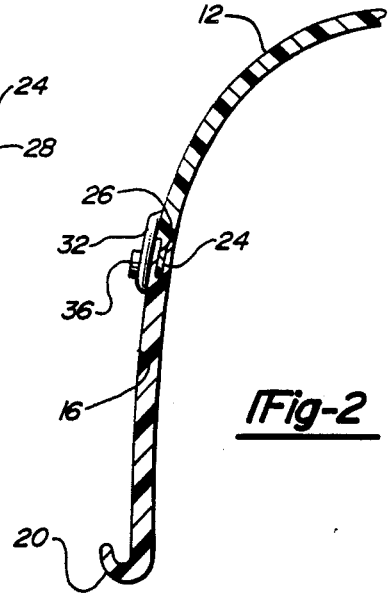
FIG. 2 is a sectional view of the hard hat of this invention as seen from the line 2—2 of FIG. 1.

The two-piece hard hat of this invention is shown in FIG. 1 and designated generally at 10. The hard hat 10 includes an upper crown member 12 which forms a dome having a generally annular periphery 14 at the lower end of the crown member. The crown member 12 is position upon a lower skirt member 16 which includes a generally upright wall 17 having an upper end 18 which is of the same shape and size as the periphery 14 of the crown member 12. The lower end of the skirt 16 is shaped so as to form a brim 20 surrounding the skirt member 16.

A tongue 24 extends downwardly from the periphery 14 of the crown member and is inserted into a complementary groove 26 in the upper end of the skirt member 16. An O-ring 28 is disposed at the bottom of the groove 26 and forms a seal between the crown member 12 and skirt member 16 to prevent liquid from leaking into the hard hat through the joint between the crown and skirt members.

A plurality of studs 30 extend outwardly from the upright wall 17 adjacent its upper end 18. The studs 30 are engaged by a plurality of spring clips 32 which are attached to the outer surface of the crown member 12 around its periphery and extend downwardly below the periphery. The spring clips include a recess 34 into which the studs 30 are inserted when the crown member 12 is secured to the skirt member 16. The spring clips 32 are compressed slightly between the enlarged heads 36 of the studs and the skirt member 16. This compression provides a friction fit between the clips 32 and studs 30 to secure the crown member 12 to the skirt member 16.

A tab 22 extends downward from the brim on each side of the hard hat which is used to mount a chin strap to the hard hat. A head band, not shown, can be secured to the inner side of the skirt member 16 for engaging the head of the user. Additionally, crown straps can be secured to the skirt member 16 which extend upward into the crown member passing over the top of the user's head. Protective padding can also be secured to the inner side of both the crown member and the skirt member.

The joint between the periphery 14 of the crown and the upper end 18 of the skirt is located at a position approximately midway along the vertical height of the hard hat as shown in FIG. 1. By positioning the joint at this location, when the crown member is separated from the skirt member, the vertical height of each member is approximately half of the total vertical height of the assembled hard hat such that the dimensions "a" and "b" shown in FIG. 1 are approximately equal. It has been found that the hard hat is able to be placed in most brief cases if the dimensions "a" and "b" are in the range of two and one half inches to three and one half inches or less. This minimizes the height of the two separate members, enabling the hard hat to be stored in a minimum amount of space in an ordinary brief case, etc.

By joining the crown and skirt members along the entire periphery of the crown member, the hard hat acts like a conventional one-piece hard hat in the manner in which loading is distributed to the crown straps enabling the two-piece hard hat to offer the same degree of protection as a conventional one-piece hard hat. As a result, the two-piece hard hat is capable of meeting applicable safety requirements for impact resistance.

It is to be understood that the invention is not limited to the exact construction or method illustrated and described above, but that various changes and modifications may be made without departing from the spirit and scope of the invention as defined in the following claims.

What is claimed is:

1. A protective hard hat assembly comprising:

an upper crown member being generally dome shaped and having a generally annular periphery;

a lower ring skirt member having a generally upright wall portion with an upper end of a shape and size corresponding to the periphery of said crown member and a lower end forming a brim; and means for detachably securing said crown member to said skirt member with the periphery of said crown member engaging the upper end of said skirt member to form said hard hat assembly, said securing means includes coacting means on said crown member periphery and said skirt member upper end forming a tongue and groove joint between said crown member and said skirt member, said crown and skirt members secured to one another at a location approximately midway of the vertical height of said hard hat assembly such that when detached, the height of each member is approximately half the height of the assembled hard hat, and a sealing ring disposed in the bottom of said groove and sealing the connection between said upper and lower members to prevent liquid from leaking into said hard hat.

2. The hard hat assembly of claim 1 wherein said securing means further comprises a plurality of studs extending radially outwardly from said skirt member adjacent the upper end of said skirt member and a plurality of spring clip means extending from said crown member downwardly below said periphery for frictional engagement with said studs to secure said crown member to said skirt member.

3. The hard hat assembly of claim 1 wherein the vertical height of both the crown and skirt members is less than approximately three and one half inches.

* * * * *